United States Patent [19]

Desai

[11] 4,374,086

[45] Feb. 15, 1983

[54] GOLD BASED MATERIAL FOR ELECTRICAL CONTACT MATERIALS

[75] Inventor: Jaydev D. Desai, Clifton Park, N.Y.

[73] Assignee: The United States of America as represented by the Secretary of the Navy, Washington, D.C.

[21] Appl. No.: 258,134

[22] Filed: Apr. 27, 1981

[51] Int. Cl.[3] ..... C22C 5/02

[52] U.S. Cl. ..... 420/507; 75/0.5 BB; 75/247; 419/12; 419/18

[58] Field of Search ..... 75/165, 0.5 BB, 0.5 BC, 75/173 A, 173 R, 172 G, 247, 202, 203, 206, 204; 252/503, 504, 514; 200/265, 266

[56] References Cited

U.S. PATENT DOCUMENTS

| | | | |
|---|---|---|---|
| 2,180,826 | 11/1939 | Hensel et al. | 75/173 R X |
| 3,069,759 | 12/1962 | Grant et al. | 75/247 X |
| 3,606,766 | 9/1971 | Hill | 75/165 X |
| 3,685,134 | 8/1972 | Blue | 75/247 X |
| 3,929,674 | 12/1975 | Patterson | 252/514 |
| 3,951,872 | 4/1976 | Neely | 75/200 X |
| 3,992,199 | 11/1976 | Neely | 75/200 |

OTHER PUBLICATIONS

Hansen, "Constitution of Binary Alloys", 2nd Ed., McGraw-Hill, 1958; pp. 252; 260–263; 265–266; 391–393; 1197–1199; 1203–1204.

Greenwood et al., "Metal Borides", Quarterly Reviews; London, vol. 20, 1966, pp. 441–464.

Aronsson et al.,"Borides, Silicides & Phosphides", 1965, pp. 10–23.

Wells, "Structural Inorganic Chemistry", 2nd Ed., Oxford Press, 1950, pp. 557–560; 593–596.

*Primary Examiner*—L. Dewayne Rutledge
*Assistant Examiner*—David Hey
*Attorney, Agent, or Firm*—Robert F. Beers; Frederick A. Wein

[57] ABSTRACT

There is presented an electrical contact material consisting of an alloy of gold and a compound selected from a group consisting of a carbide, a boride, or a silicide of a refractory element. The compound of the refractory element is selected from a group consisting of WC, $Hfb_2$, $TiB_2$, $ZrB_2$, $WSi_2$, and $TiSi_2$. The resulting alloys have a hexagonal crystal structure and exhibit high wear resistance, low contact resistance, low electrical noise, and a homogeneous uncontaminated microstructure.

1 Claim, No Drawings

GOLD BASED MATERIAL FOR ELECTRICAL CONTACT MATERIALS

BACKGROUND OF THE INVENTION

The present invention relates to low energy slip rings, and more particularly, to gold based materials for use as slip ring materials.

Materials suitable for use in low energy slip rings must have high wear resistance, low contact resistance, and a homogeneous uncontaminated microstructure. Accordingly, such materials must have high conductivity, high hardness and wear resistance, high tarnish resistance, low contact noise, and little or no tendency toward catalytic formation of friction polymers. In the past, these considerations have led to virtually exclusive dependance upon gold based materials. Currently used gold based materials utilize cold working, solid solution hardening, precipitation hardening, or order hardening, which generally benefits strength, hardness and wear resistance but have detrimental effects on the electrical and chemical properties of gold.

Nickel, cobalt, or cadmimum hardened electroplated gold exhibit high hardness, high wear resistance and have a reasonably high conductivity but such materials often have included contaminants, such as, KCN, porosity, codeposited polymers, and the like. Moreover it is hypothesized that such materials have a non-homogeneous structure. Additionally, the properties of hardened electroplated gold are strongly dependant upon the substrate and plating conditions. Thus, consistently high quality electroplates require not easily achieved stringent controls during processing. Accordingly it is desirable to provide a gold based material which will exhibit high hardness with high wear resistance, high strength and high conductivity with a homogeneous and uncontaminated structure.

SUMMARY OF THE INVENTION

Briefly, gold based materials suitable for use as electrical contact material are presented. The contact material comprises gold alloys with a compound selected from a group consisting of a carbide, a boride, or silicide of a refractory element such as WC, $Hfb_2$, $TiB_2$, $ZrB_2$, $WSi_2$ and $TiSi_2$. These compounds have a hexagonal crystal structure resulting in hardness with high wear resistance. The contact materials therefore have high hardness with high wear resistance, high strength, and high conductivity with a homogeneous and uncontaminated structure.

OBJECTS OF THE INVENTION

Accordingly, it is an object of the present invention to provide material of gold exhibiting high wear resistance, high hardness, high strength, and high conductivity with a homogeneous uncontaminated structure. Another object of the present invention is to provide a gold base material usable as a contact material and comprising gold and a compound selected from the group consisting of a carbide, a boride, or a silicide of a refractory element. A further object of the present invention is to provide a material for low energy slip rings comprising a gold and a compound having a hexagonal crystal structure.

Further objects and advantages of the present invention will become apparent as the following description proceeds and the features of novelty characterizing the invention will be pointed with particularity in the claims annexed to and forming a part of this specification.

DETAILED DESCRIPTION OF THE PREFERRED EMBODIMENT

The present invention relates to gold based materials for the use as a contact material. Carbides, borides, and silicides, have extremely high hardness and some of their compounds exhibit extremely high conductivity and good tarnish resistance at room temperature. When mixed in powder form with gold powder, compacted and sintered, such materials as disclosed hereinafter, produce desirable electrical contact materials.

Materials which can be mixed in the powder form with gold powder are: carbides such as WC; borides such as $HfB_2$, $TiB_2$, $ZrB_2$, and silicides such as $WSi_2$, and $TiSi_2$. Of these, the borides and carbides have hexagonal crystal structure which provides for higher wear resistance. When used as a controlled second phase (e.g., quantity, particle size, and distribution) with a pure gold matrix, high hardness and wear resistance will be maintained throughout the structure and the electrical conductivity will not be impared by the hard second phase. Additionally, the fine, uniformly distributed particles are excellent from an electrical contact standpoint in that contact zones of at least a few microns in diameter will each contain several of the second phase particles along with the pure gold matrix.

More particularly, a 99.99% pure gold powder is mixed with high purity powder of the refractory element compound and pressed at 50,000 psi by cold isostatic pressing. The pressed compacts are than sintered at two different temperatures of 900° C. and 1,000° C. for two hours at each temperature. For the gold-WC sample the resulting compact is more than 97% dense and has hardness of approximately 58 DPH (Diamond Pyramid Hardness) and a resistivity approximately 3 μohm-cm.

Thus, there is presented an electrical contact material consisting of an alloy of gold and a compound selected from a group consisting of a carbide, a boride, or a silicide of a refractory element. The compound of the refractory element is selected from a group consisting of WC, $HfB_2$, $TiB_2$, $ZrB_2$, $WSi_2$ and $TiSi_2$. The resulting boride and carbide materials have a hexagonal crystal structure and exhibit high wear resistance, low contact resistance, low electrical noise, and a homogeneous uncontaminated microstructure.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent is:

1. An electrical contact comprising, as a contact material, a gold based sintered powder compact consisting essentially of a high purity gold powder of at least 99.99 percent purity, and a high purity powder of a compound selected from a group consisting of WC, $HfB_2$, $TiB_2$, $ZrB_2$, $WSi_2$ and $TiSi_2$ and having a hexagonal crystaline structure, the compact having a 97 percent density, a hardness of approximately 58 DPH, and a resistivity of approximately 3 μohm-cm, and having been pressed by cold isostatic pressure of at least 50,000 psi and sintered at a first temperature of approximately 900° C. for approximately two hours followed by a second temperature of approximately 1,000° C. for two hours.

* * * * *